US006351216B1

(12) United States Patent
Frederick et al.

(10) Patent No.: US 6,351,216 B1
(45) Date of Patent: Feb. 26, 2002

(54) LARGE SIGNAL NOISE CANCELLATION IN ELECTRONIC ARTICLE SURVEILLANCE

(75) Inventors: Thomas J. Frederick, Coconut Creek; Jeffrey T. Oakes, Boca Raton, both of FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/777,293

(22) Filed: Feb. 5, 2001

(51) Int. Cl.[7] ..... G08B 13/14
(52) U.S. Cl. ..... 340/572.4
(58) Field of Search ..... 340/572.4, 572.1, 340/551, 552; 324/233

(56) References Cited

U.S. PATENT DOCUMENTS 4,510,489 A 4/1985 Anderson et al. ..... 340/572
4,854,113 A * 8/1989 Strosser et al. ..... 56/10.2 J
5,602,531 A * 2/1997 Rude et al. ..... 340/572
5,673,024 A * 9/1997 Frederick et al. ..... 340/572
5,699,045 A * 12/1997 Frederick et al. ..... 340/551

* cited by examiner

*Primary Examiner*—John Tweel
(74) *Attorney, Agent, or Firm*—Rick F. Comoglio; Paul T. Kashimba

(57) ABSTRACT

In an EAS system and method, a reference antenna is used to spatially separate the interference and tag signal allowing the interference signal to be removed, which improves performance of the EAS receiver. The reference antenna is coupled to the system by an adaptive filter, which can be a software filter that is continually adapting itself to optimum performance. The continuous adaptation obviates the need for manually tuning the coupling network and permits the system to perform at its optimum level over long periods of time.

11 Claims, 6 Drawing Sheets

Gaussian, or "Normal" Curve vs. Impulse Noise Distribution

Windowing Function Used to Eliminate Transmitter Noise

LARGE SIGNAL NOISE CANCELLATION IN ELECTRONIC ARTICLE SURVEILLANCE

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Technical Field

This invention relates to electronic article surveillance (EAS) systems, and more particularly to noise reduction in EAS receivers.

2. Description of the Related Art

EAS systems are typically used to prevent unauthorized removal of articles from a protected area. EAS tags are attached to articles designated for protection, and when active, the EAS tags will trigger an action, such as setting off an alarm, if carried through an EAS interrogation zone. EAS interrogation zones are typically positioned at the exits of the protected area. For authorized removal of an article, the attached EAS tag is removed or deactivated so the article can be carried through the interrogation zone and removed from the protected area without triggering the EAS system. EAS markers, labels, and tags are used interchangeably herein and refer to markers, labels, tags, and the like that trigger EAS systems.

There are several types of EAS systems presently in use including RF, microwave, harmonic, and acoustomagnetic or magnetomechanical. Magnetomechanical EAS systems are used herein to describe one embodiment of the invention, but can be applied to other types of EAS systems within the scope of this disclosure. A magnetomechanical EAS marker is typically made of a "resonator", an elongated strip of magnetostrictive ferromagnetic material, disposed adjacent a "bias", a ferromagnetic element that, when magnetized, magnetically biases the strip and arms it to resonate mechanically at a preselected resonant frequency. The marker resonates when subjected to an electromagnetic interrogation field at a frequency at or near the marker's resonant frequency. The response of the marker can be detected by an EAS receiver, which can trigger an alarm. A complete description of a magnetomechanical EAS system is given in U.S. Pat. No. 4,510,489.

Common electronic devices such as flourescent lights, computer monitors, power control circuitry, and other electronic noise sources may interfere with EAS receivers. These noise sources increase the noise level at the EAS system's receive antenna causing a reduction in sensitivity. The reduction in sensitivity makes it more difficult to detect EAS tags that are far from the receive antenna, and makes desirable wide antenna separation to accommodate wide exits difficult to achieve.

Retailers are demanding wide separations between receive antennas, which requires that the detection algorithm be very sensitive as it must detect a tag far away from the receive antenna. In electrically noisy environments this is not always possible because the noise source may overlap the tag signal in both time and frequency, making, separation of the tag and noise signals difficult or impossible using only the receive antenna input.

One solution to the noise problem has been to change the antenna pattern so that there is a null in the direction of the interference source. Summing multiple sub-antennas (coils) within the main antenna in such a way as to produce the desired antenna pattern typically does this. The procedure involves manual optimization, which will not automatically adjust to changing environments, and does not always produce a working solution. The altered antenna pattern will generally affect tag sensitivity making tag detection more difficult.

An alternate solution involves adding a reference antenna together with a manually adjusted hardware-coupling network. The reference antenna is spatially separated from the main receive antenna in such a way that the reference antenna senses the interference signal but does not sense the tag signal. The two antenna inputs can then be combined using a coupling network in such a way that the noise is effectively canceled. The coupling network typically is tuned to match the noise source and environment. This procedure also involves manual optimization and will not automatically adjust to changing environments. The required hardware-coupling network may match gain and phase at only one or more frequencies, and will not easily work as a general primary vs. reference channel equalizer, as is desired.

The use of a reference antenna may make it possible to regain some of the system sensitivity lost to noise sources, however, because of the nature of a typical retailer's environment the noise sources may be turned on and off and/or moved periodically. This requires a service call for the coupling network to be manually retuned to restore system sensitivity. Even worse, some noise sources change during the day, so that full system performance is never restored. A network that regains lost sensitivity due to noise, and automatically tunes itself is desirable.

BRIEF SUMMARY OF THE INVENTION

An EAS receiver, and corresponding method, is provided that includes a primary antenna for receiving a first signal, which includes an EAS tag signal and an interference noise signal. The primary antenna is coupled to a primary channel for amplifying and filtering the first signal. A reference antenna is used for receiving a second signal, which includes the interference noise signal. The reference antenna is coupled to a reference channel for amplifying and filtering the second signal. An adaptive filter is connected to the reference channel output. The adaptive filter is responsive to an update algorithm. The output of the adaptive filter is approximately equal to the interference noise signal. A summing network is connected to the adaptive filter output and to the primary channel output. The output of the adaptive filter is subtracted from the output of the primary channel. The resulting output of the summing network is approximately equal to the EAS tag signal. The adaptive filter can be updated according to the output of the reference channel and to an error signal from the summing network.

A detection filter can be connected to the summing network to detect a valid EAS tag signal. A sample and hold circuit is connected to the detection filter for sampling and holding the EAS tag signal. A threshold comparison is performed between the sampled and held EAS tag signal and a selected threshold value. An output signal is provided to indicate whether the sampled and held EAS tag signal is greater than the selected threshold value indicating an EAS tag has been detected.

In a second aspect of the invention, an EAS receiver is provided that includes a primary antenna for receiving a first signal (z), which includes an EAS tag signal (x) and an interference noise signal (y) wherein z=x+y. The primary antenna is coupled to a primary channel for amplifying and filtering the first signal wherein the amplified and filtered first signal equals $z_1=x_1+y_1$. The primary channel has a transfer function $H_1$. A reference antenna is used for receiving a second signal, which includes the interference noise signal (y). The reference antenna is coupled to a reference channel for amplifying and filtering the second signal wherein the amplified and filtered second signal equals ($y_2$). The reference channel has a transfer function $H_2$. An adaptive filter having a transfer function $W=(H_2)^{-1}\cdot H_1$ is connected to the reference channel. The adaptive filter is responsive to an update algorithm. An output of the adaptive filter ($y_W$) is approximately equal to the interference noise signal ($y_1$), wherein $y_w=W\cdot y_2\approx y_1$. A summing network is connected to the adaptive filter output and to the primary channel output. The output of the adaptive filter ($y_w$) is subtracted from the output of the primary channel ($z_1$), wherein the output of the summing network is approximately equal to the EAS tag signal ($x_1$), wherein $e=z_1-y_w=x_1+y_1-y_w\approx x_1+y_1-y_1\approx x_1$.

The update algorithm is updated according to a filter update algorithm $W_{(n+1)}=W_{(n)}+\mu\cdot y_2\cdot e$, where (n) refers to the nth iteration of receiver processing and $\mu$ is a gain constant affecting the tracking bandwidth.

In a third aspect of the invention, an EAS system responsive to the presence of an EAS tag within an interrogation zone is provided that includes an interrogation zone formed by a transmitter and antenna that generates an electromagnetic field within the interrogation zone. A receiver and receive antenna for detecting an EAS tag disposed in said interrogation zone. The receiver made as described herein, including a primary antenna for receiving a first signal, which includes an EAS tag signal and an interference noise signal. The primary antenna is coupled to a primary channel for amplifying and filtering the first signal. A reference antenna is used for receiving a second signal, which includes the interference noise signal. The reference antenna is coupled to a reference channel for amplifying and filtering the second signal. An adaptive filter is connected to the reference channel output. The adaptive filter is responsive to an update algorithm. The output of the adaptive filter is approximately equal to the interference noise signal. A summing network is connected to the adaptive filter output and to the primary channel output. The output of the adaptive filter is subtracted from the output of the primary channel. The resulting output of the summing network is approximately equal to the EAS tag signal if one is present.

Objectives, advantages, and applications of the present invention will be made apparent by the following detailed description of embodiments of the invention.

DETAILED DESCRIPTION OF THE INVENTION

Figure 1:
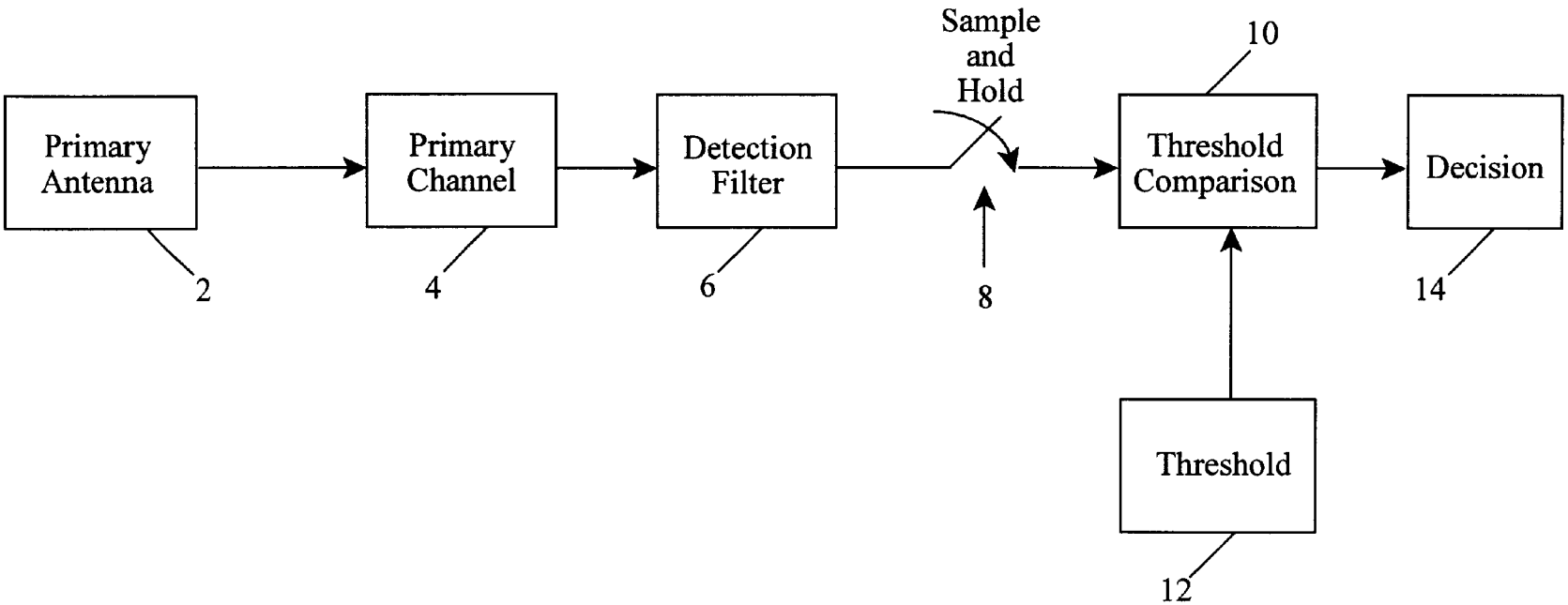
FIG. 1 PRIOR ART
FIG. 1 is a block diagram of a prior art EAS receiver.

Referring to FIG. 1, a typical magnetomechanical EAS receiver is illustrated. The signal from the primary receive antenna 2 is amplified and filtered as represented by the primary channel block 4, then passed into the detection filter 6, which is typically a type of matched filter. The output of the detection filter 6 is sampled 8 at the optimum point in time and compared to a threshold 10. If the detection filter 6 output is above the threshold 12, the decision 14 is made that a tag is present and an alarm is sounded, otherwise it is decided that no tag is present. The threshold 12 is chosen to give an acceptable tradeoff between false alarm rate and detection rate. When interference is present at the primary antenna 2 and the noise level is high, then the threshold 12 must be raised to keep the false alarm rate low. This is at the expense of sensitivity, or detection rate and range.

Figure 2:
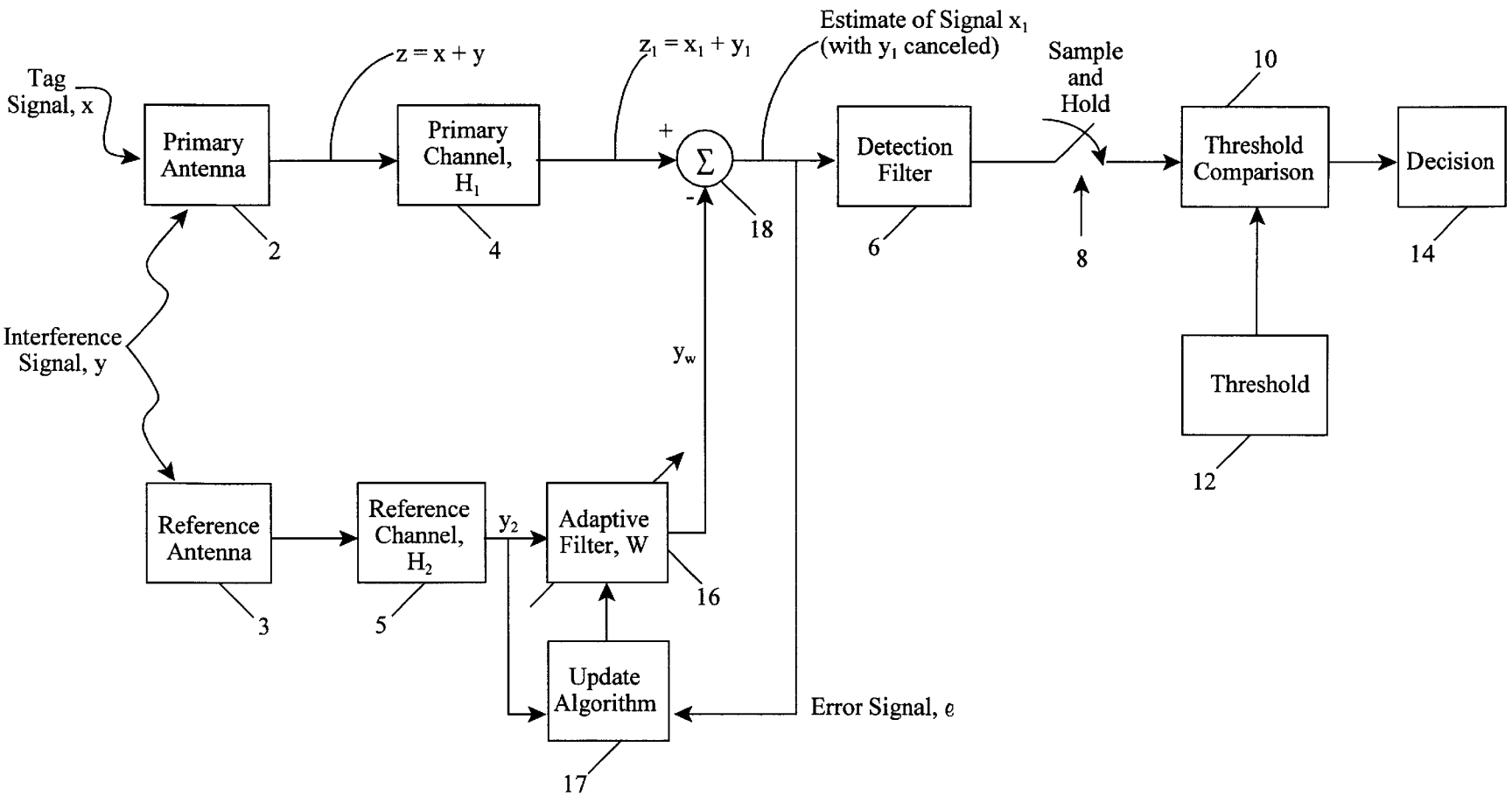
FIG. 2 is a block diagram illustrating one embodiment of the present invention.

Referring to FIG. 2, one embodiment of the present invention is illustrated and described below generally and in detail. Components in the figures that are identical are labeled with the same reference numerals. The tag signal is referred to as x, while the interference signal is referred to as y. In general, a reference antenna 3 is placed such that it senses the interference signal y, but not the tag signal x. The reference signal is passed through its own filtering and gain reference channel 5, followed by an adaptive filter 16, which can be part of the system software. The output of the adaptive filter 16 is an estimate of the interference signal y present at the output of the primary channel 4. The interference estimate is subtracted from the primary channel output 18, thereby canceling the interference.

The cleaned up, or "conditioned" signal is then passed to the remainder of the detector. Since the interference signal y has been removed, the threshold 12 at the sampled output 8 of the detection filter 6 can be lowered for comparison 10, without causing excessive false alarm probability. This gives the receiver the desired sensitivity to detect the tag signal x in the presence of noise from an interference signal y. The adaptive filter 16 is continually monitoring its input and modifying its parameters using an update algorithm 17 so that it remains optimally tuned.

In detail, the primary antenna 2 receives both the tag signal x and the interference signal y, and the output of the primary antenna is denoted z, where z=x+y. The reference antenna 3 is placed so that it senses the interference signal y, but not tag signal x. Additional noise may also be received by antenna 3, which can essentially be ignored as long as antenna 3 receives interference signal y and not tag signal x. The primary 2 and reference 3 antennas have separate gain and filtering paths referred to as primary channel 4 and reference channel 5, represented by functions $H_1$ and $H_2$, respectively. These channels are both assumed to be linear, so that the output of the primary channel $z_1=x_1+y_1$, while the output of the reference channel is $y_2$.

The adaptive filter 16 is represented by a function W, which is configured so that its output is a close approximation of $y_1$, i.e., $$y_w=w\cdot Y_2\approx y_1.$$

Therefore, the output of the summing junction 18 is $$e=z_1-y_w=x_1+y_1-y_w\approx x_1+y_1-y_1\approx x_1.$$

In order for W to form an approximation of $y_1$, it must provide the transfer function $$W=(H_2)^{-1}\cdot H_1.$$

In effect, the adaptive filter 16 equalizes the channel differences between the primary channel 4 and the reference channel 5. An algorithm commonly used for adaptive equalizers is known as the Least Mean Squares, or LMS algorithm. Using this algorithm, the adaptive filter update algorithm 17 is $$W_{(n+1)}=W_{(n)}+\mu \cdot y_2 \cdot e,$$

where the index n refers to the nth iteration of the receiver processing and $\mu$ is a gain constant affecting the tracking bandwidth. In this manner, the adaptive filter 16 automatically adapts to the correct setting.

Figure 3:
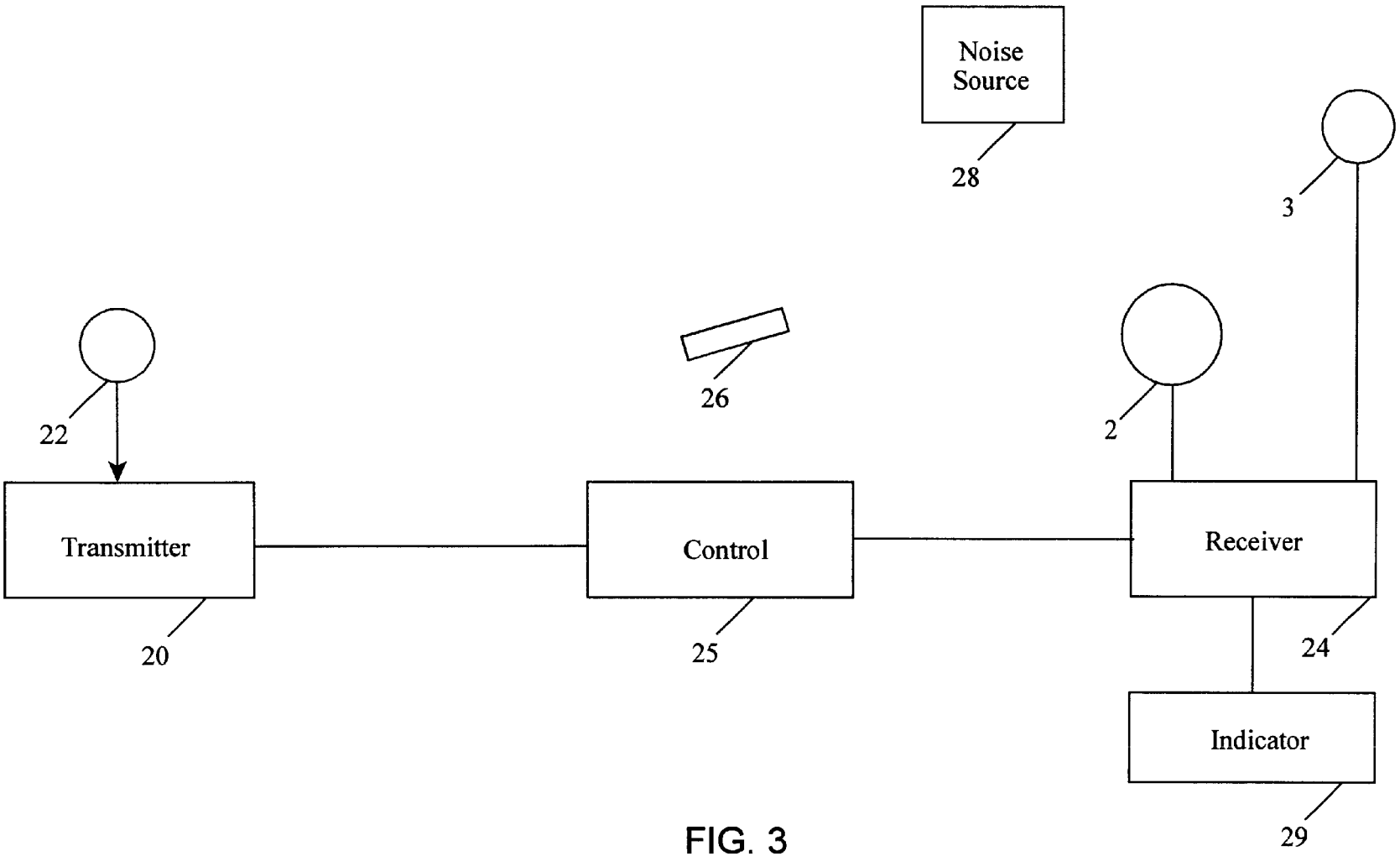
FIG. 3 is a block diagram of an EAS system incorporating a receiver made in accordance with the present invention.

Referring to FIG. 3, an EAS system incorporating the invention is illustrated. Transmitter 20 and transmit antenna 22 transmits the interrogation electromagnetic field into the interrogation zone that is defined between transmit antenna 22 and receive antenna 2. In an alternate embodiment, transmit and receive, or transceiver, antennas can be used in place of separate antennas. Transmitter 20 and receiver 24 are controlled by controller 25, which includes synchronization of transmit and receive windows in a pulsed embodiment. Receiver 24 includes the invention as described and illustrated hereinabove. Active EAS tag 26 produces a valid EAS tag signal upon being moved into the interrogation zone. The EAS tag signal along with noise from interfering noise source 28 is received by receive antenna 2. Noise source 28 represents all noise in the environment of the EAS system including that which, when received at receive antenna 2, may interfere with detection of EAS tag 26. Reference antenna 3 receives noise from noise source 28. Once a valid EAS tag signal is detected according to the description hereinabove, an output signal can trigger indicator 29, which can be an alarm.

Referring again to FIG. 2, using an LMS algorithm for the update algorithm 17 performs satisfactorily when the interference noise signally is primarily Gaussian, which may be the case in certain installations. However, in many operational environments the noise signals are not Gaussian, but include impulse components in the noise signal. Furthermore, due to coupling of the transmitter into the reference antenna there may be correlation between the noise reference signal and the desired tag signal, which we do not want to cancel. To mitigate these problems, two improvements to the LMS update algorithm have been made and are illustrated in FIG. 4.

Figure 4:
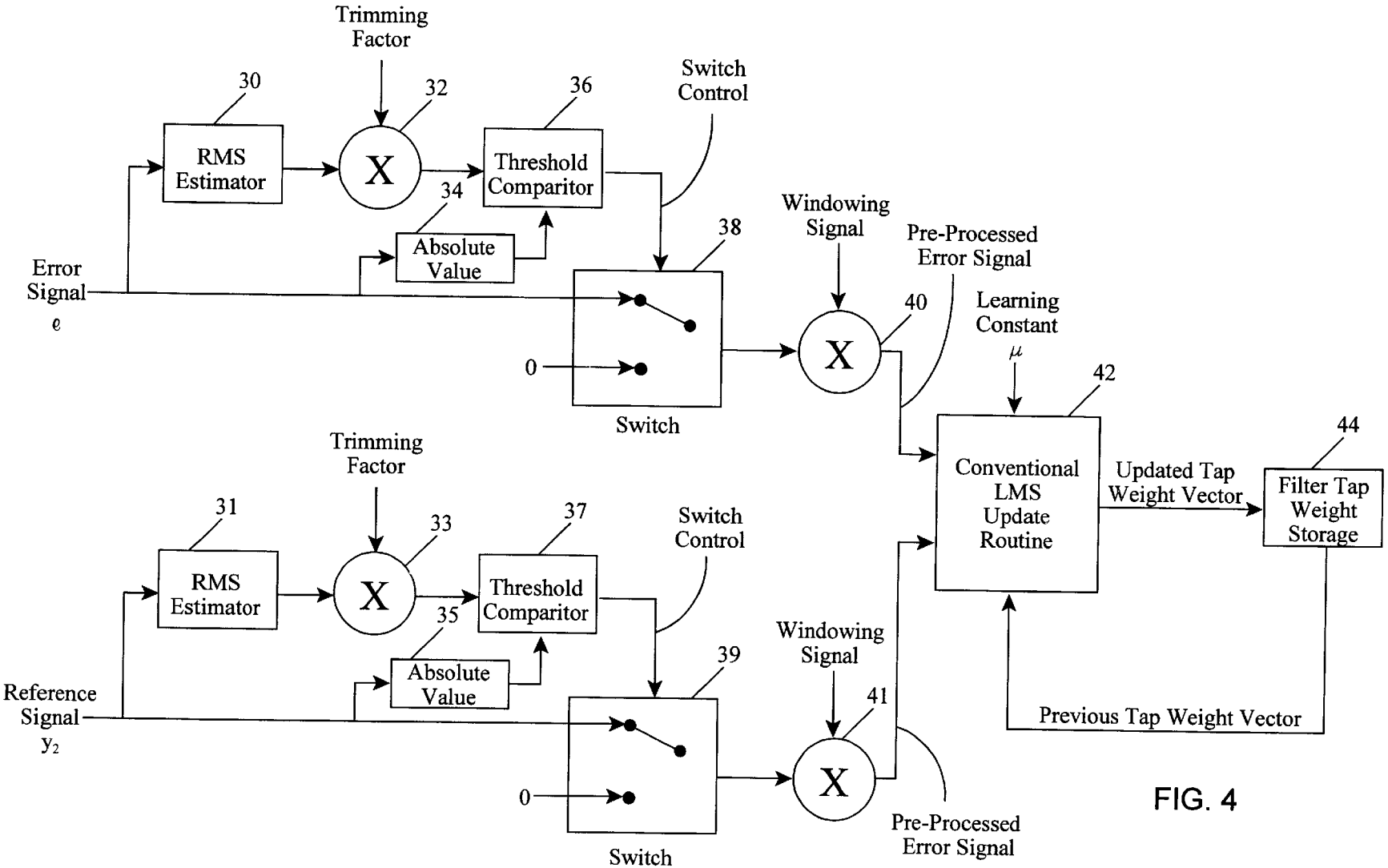
FIG. 4 is a block diagram illustrating an adaptive filter update algorithm used with the present invention.

Referring to FIG. 4, both the error signal, e, and the reference channel, $y_2$, undergo trimming algorithms. In the trimming algorithms, the root mean square (RMS) level of the error and reference channel signals are estimated at 30, 31, respectively, and tracked over a much larger time frame than a single receive window. The estimated RMS levels are then multiplied at 32, 33 by a trimming factor selected to eliminate impulse noise components in the signals. The estimated RMS value times the trimming factor yields the trimming threshold. For example, if the noise were truly Gaussian and the RMS estimator was perfect, then a trimming factor of 3 would eliminate less than one percent of the data. A complete description of the trimming factor is given hereinbelow with reference to FIG. 5. The absolute value of the error signal 34 and the absolute value of the reference channel 35 are compared to their respective trimming thresholds at 36 and 37, respectively. Any level above the threshold is replaced with zeros at 38 and 39, respectively. In this manner, impulse noise does not adversely affect the tap weights of the adaptive algorithm.

A second adaptation of the LMS update algorithm is a windowing function at 40 and 41, respectively, that is selected to reduce or eliminate portions of the signal where correlation between the reference signal and the desired EAS tag signal are suspected to exist. This is commonly in the portions of the signal closest in time to the transmitter signal. A complete description of the windowing function is given hereinbelow with reference to FIG. 6. When a valid EAS tag is detected, the windowing function goes to zero. The tap weight vectors are then basically clamped at their present value and further updates are prevented until the tag is removed from the interrogation zone. Once adjusted with the windowing signals at 40 and 41, the preprocessed error and reference signals are sent into a standard or block LMS update algorithm 42, which sends an updated tap weight vector to tap weight storage 44, used to update adaptive filter 16, shown in FIG. 2.

Figure 5:
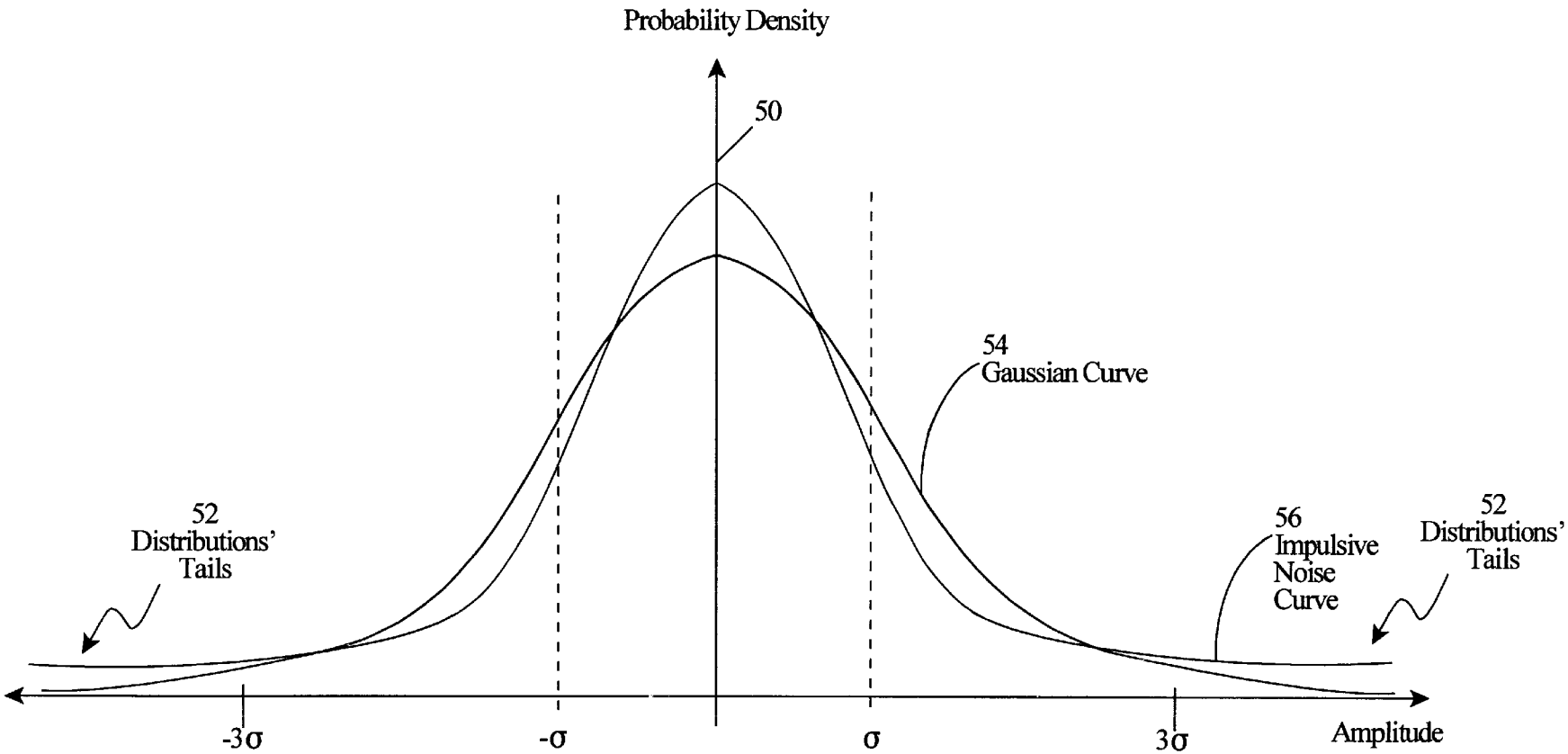
FIG. 5 is a plot of noise probability density functions for Gaussian and non-Gaussian noise distributions verses signal amplitude.

Referring to FIG. 5, the plots illustrate probability density verses signal amplitude. For normally distributed, or Gaussian, noise, the signal amplitude is most probable within a couple standard deviations ($\sigma$) of the mean 50. The standard deviation $\sigma$ is a classical measurement of the distribution spread. The distribution tails 52 are the areas of the curves that decay toward zero. For the Gaussian curve 54, the tails decay toward zero at a rate proportional to $e^{-x^2}$. This indicates that the signal is very unlikely to have extremely high amplitude values. However, because the actual environmental noise distribution may include impulse noise, the tail of the impulse noise curve 56 decays more slowly toward zero, which means it is more likely to produce very high amplitude outputs. The trimming algorithm described hereinabove estimates the RMS level of the input signal, at 30 and 31 in FIG. 4. The estimated RMS level is used as a measure of the spread of the signal's amplitude probability distribution. If the signal is Gaussian, the RMS value is equal to the standard deviation $\sigma$. The estimated RMS level is then multiplied by the trimming factor, typically around 3. This value is chosen as a starting point since, for Gaussian noise, more than 99% of the signals will have absolute values less than this number, i.e., little trimming will occur, and will result in little change to the LMS tap weights. However, signal values 10 or even 100 times the estimated RMS value are possible for impulse noise. These signals would have a significant impact on the LMS tap weights if they were not trimmed to zero, at 38 and 39 in FIG. 4. Once they are set to zero, they have no effect on the tap weights.

Figure 6:
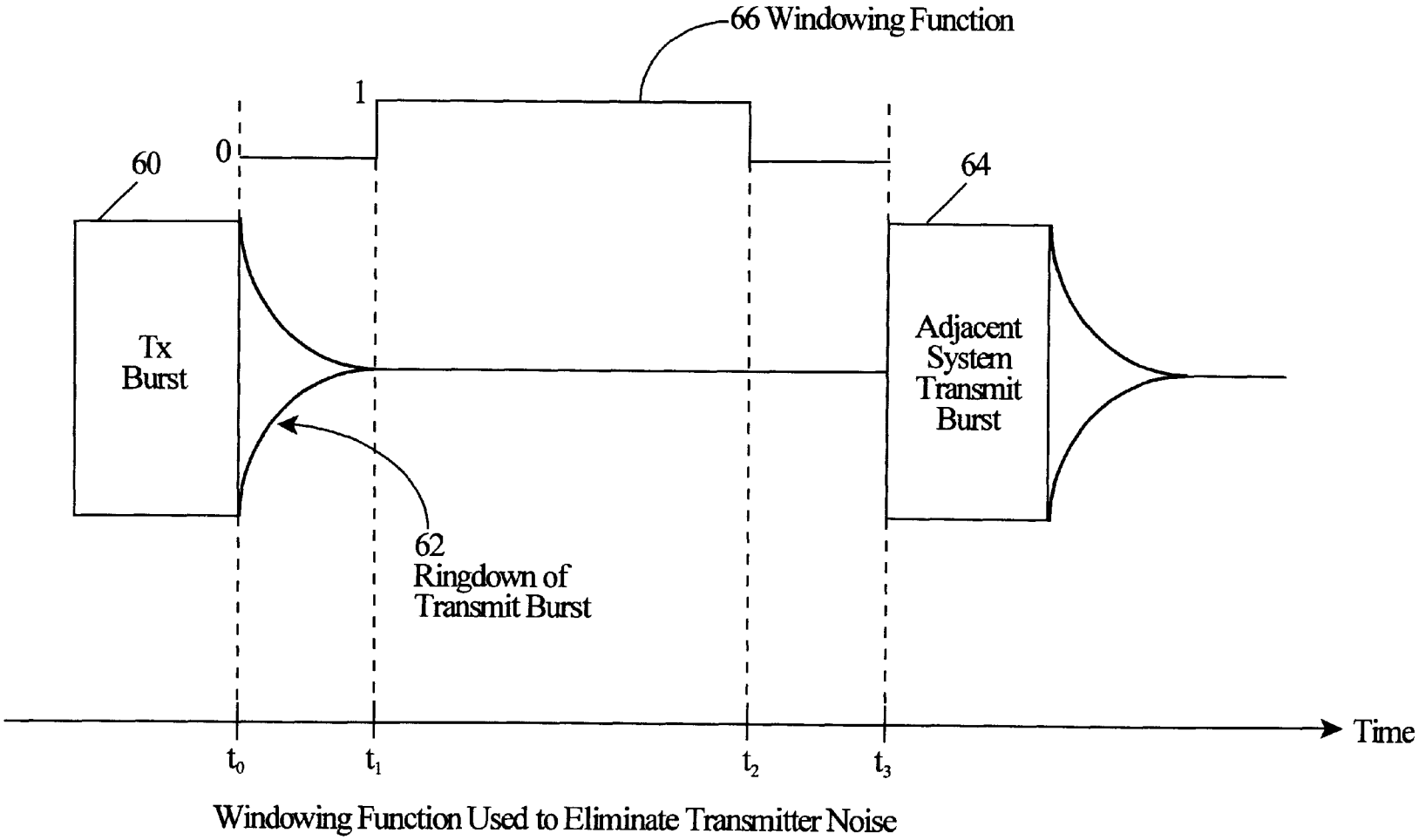
FIG. 6 is a plot of the windowing function used to eliminate transmitter noise.

Referring to FIG. 6, the windowing function used in the update algorithm for a pulsed system is illustrated. The transmit burst 60 ends at time $t_0$. At this time, the receiver front end opens up and begins listening to the environment for EAS tags. However, it takes until time $t_1$ for all of the transmit energy to dissipate from the transmit antenna. This energy, which is present in the transmit ring down 62, will appear as interference in the primary antenna 2, and perhaps in the reference antenna 3. In addition, adjacent EAS systems will begin transmitting adjacent transmit bursts 64 nominally at time $t_3$. Due to jitter on the timing reference, which is typically the power line signal, the systems may in fact begin transmitting at time $t_2$. At time $t_2$, the receiver window may still be open causing these adjacent system signals 64 to appear as noise in both the primary antenna 2 and the reference antenna 3. Rather than permit the LMS canceller to waste resources canceling transmitter interference, another filter in the signal processing system, which is more efficient at removing this disturbance, is used. LMS canceller resources are limited because for a given number of LMS filter taps, there is only so much equalization that can be accomplished. LMS resources would be wasted by trying to cancel transmitter noise, rather than canceling the intended environmental noise. In order to keep the transmitter interference from influencing the tap weights, the windowing function 66 is utilized to zero out the portions of the signal inside the update algorithm, which would contain the transmitter interference. The zeroing occurs only in the update algorithm, after the filtering and cancellation portion.

When an alarm is active, indicating that an EAS tag has been detected in the system, the update algorithm, 17 in FIG. 2, is halted completely. When the tag is removed, the update algorithm continues. This minimizes adverse effects to the tap weights in case some of the tag signal reaches the reference antenna 3 and well as the primary antenna 2.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. An electronic article surveillance (EAS) receiver, comprising:

primary antenna means for receiving a first signal comprising an EAS tag signal and an interference noise signal, said primary antenna means coupled to a primary channel means for amplifying and filtering said first signal;

reference antenna means for receiving a second signal comprising said interference noise signal, said reference antenna means coupled to a reference channel means for amplifying and filtering said second signal;

an adaptive filter connected to said reference channel means, said adaptive filter responsive to an update algorithm including means for updating said adaptive filter, an output of said adaptive filter being approximately equal to said interference noise signal; and, summing means, connected to said adaptive filter and to said primary channel means, for subtracting the output of said adaptive filter from an output of said primary channel means, wherein an output of said summing means is approximately equal to said EAS tag signal.

2. The device of claim 1 wherein said means for updating said adaptive filter is responsive to a reference signal equal to the output of said reference channel means and to an error signal from said summing means.

3. The device of claim 2 further comprising:

detection filter means, connected to said summing means, for detecting said EAS tag signal;

sample and hold means, connected to said detection filter means, for sampling and holding a portion of said EAS tag signal; and, means for threshold comparison, connected to said sample and hold means, for comparing said sampled and held portion of said EAS tag signal to a selected threshold value and providing an output signal to indicate whether said sampled and held portion of said EAS tag signal is greater than said selected threshold value indicating an EAS tag has been detected.

4. An electronic article surveillance (EAS) receiver, comprising:

primary antenna means for receiving a first signal (z) comprising an EAS tag signal (x) and an interference noise signal (y) wherein $z=x+y$, said primary antenna means coupled to a primary channel means for amplifying and filtering said first signal wherein the amplified and filtered first signal equals $z_1=x_1+y_1$, said primary channel means having a transfer function $H_1$;

reference antenna means for receiving a second signal comprising said interference noise signal (y), said reference antenna means coupled to a reference channel means for amplifying and filtering said second signal wherein the amplified and filtered second signal equals ($y_2$), said reference channel means having a transfer function $H_2$;

an adaptive filter having a transfer function $W=(H_2)^{-1}\cdot H_1$, connected to said reference channel means, said adaptive filter responsive to an update algorithm and including means for updating said adaptive filter, an output of said adaptive filter ($y_w$) being approximately equal to said interference noise signal ($y_1$), wherein $y_w=W\cdot y_2\approx y_1$; and, summing means, connected to said adaptive filter and to said primary channel means, for subtracting the output of said adaptive filter ($y_w$) from an output of said primary channel means ($z_1$), wherein an output of said summing means is approximately equal to said EAS tag signal ($x_1$), wherein $e=z_1-y_w=x_1+y_1-y_w\approx x_1+y_1-y_1\approx x_1$.

5. The device of claim 4 wherein said means for updating said adaptive filter comprises a filter update algorithm $W_{(n+1)}=W_{(n)}+\mu\cdot y_2\cdot e$, where (n) refers to the nth iteration of receiver processing and u is a gain constant affecting the tracking bandwidth.

6. A method for receiving an electronic article surveillance (EAS) tag signal in the presence of interfering noise, comprising:

receiving a first signal comprising an EAS tag signal and an interference noise signal;

amplifying and filtering said first signal;

receiving a second signal comprising said interference noise signal;

amplifying and filtering said second signal;

adaptively filtering said second signal to approximate said interference noise signal portion of said first signal, including updating an adaptive filter update algorithm; and, subtracting the adaptively filtered second signal from said first signal, the difference being approximately equal to said EAS tag signal.

7. The method of claim 6 wherein said act of updating the adaptive filter update algorithm is responsive to a reference signal equal to the amplified and filtered second signal and an error signal from said subtracting.

8. The method of claim 7 further comprising:

detecting said EAS tag signal after said subtracting;

sampling and holding a portion of said EAS tag signal;

comparing said sampled and held portion of said EAS tag signal to a threshold value and, if said sampled and held portion of said EAS tag signal is greater than said threshold value, providing an output signal indicating that an EAS tag has been detected.

9. An electronic article surveillance (EAS) system responsive to the presence of an EAS tag within an interrogation zone, comprising:

means for defining an interrogation zone;

generating means for generating an electromagnetic field within said interrogation zone;

detecting means for detecting an EAS tag disposed in said interrogation zone, said detecting means including;

primary antenna means for receiving a first signal comprising an EAS tag signal and an interference noise signal, said primary antenna means coupled to a primary channel means for amplifying and filtering said first signal;

reference antenna means for receiving a second signal comprising said interference noise signal, said reference antenna means coupled to a reference channel means for amplifying and filtering said second signal;

an adaptive filter connected to said reference channel means, said adaptive filter responsive to an update algorithm and including means for updating said adaptive filter, an output of said adaptive filter being approximately equal to said interference noise signal; and, summing means, connected to said adaptive filter and to said primary channel means, for subtracting the output of said adaptive filter from an output of said primary channel means, wherein an output of said summing means is approximately equal to said EAS tag signal.

10. The device of claim 2 wherein said means for updating said adaptive filter comprises:

means for estimating an RMS value of said error signal, means for multiplying the estimated RMS value of said error signal with a first trimming factor wherein the product equals a first threshold value, comparator means for comparing the first threshold value with the absolute value of said error signal, means for driving said error signal to zero if the absolute value of said error signal is above said first threshold value, means for multiplying the error signal by a first windowing signal;

means for estimating an RMS value of said reference signal, means for multiplying the estimated RMS value of said reference signal with a second trimming factor wherein the product equals a second threshold value, comparator means for comparing the second threshold value with the absolute value of said reference signal, means for driving said reference signal to zero if the absolute value of said reference signal is above said second threshold value, means for multiplying the reference signal by a second windowing signal; and, wherein the products of said first and second windowing signals and said error and reference signals, respectively, are inputs to an LMS adaptive filter update algorithm.

11. The method of claim 7 wherein said act of updating the adaptive filter update algorithm comprises:

estimating an RMS value of said error signal, multiplying the estimated RMS value of said error signal with a first trimming factor wherein the product equals a first threshold value, comparing the first threshold value with the absolute value of said error signal, driving said error signal to zero if the absolute value of said error signal is above said first threshold value, multiplying the error signal by a first windowing signal;

estimating an RMS value of said reference signal, multiplying the estimated RMS value of said reference signal with a second trimming factor wherein the product equals a second threshold value, comparing the second threshold value with the absolute value of said reference signal, driving said reference signal to zero if the absolute value of said reference signal is above said second threshold value, multiplying the reference signal by a second windowing signal; and, wherein the products of said first and second windowing signals and said error and reference signals, respectively, are input to an LMS adaptive filter update algorithm.

* * * * *

UNITED STATES PATENT AND TRADEMARK OFFICE

CERTIFICATE OF CORRECTION

PATENT NO. : 6,351,216 B1
DATED : February 26, 2002
INVENTOR(S) : Frederick et al.

It is certified that error appears in the above-identified patent and that said Letters Patent is hereby corrected as shown below:

Column 5,
Line 36, replace "noise singally is" with -- noise signal y is --.

Signed and Sealed this

Twenty-first Day of May, 2002

*Attest:*

*Attesting Officer*

JAMES E. ROGAN
*Director of the United States Patent and Trademark Office*